US007501758B2

(12) United States Patent
Ahn

(10) Patent No.: US 7,501,758 B2
(45) Date of Patent: Mar. 10, 2009

(54) PLASMA DISPLAY APPARATUS

(75) Inventor: Sung Yong Ahn, Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 382 days.

(21) Appl. No.: 11/276,660

(22) Filed: Mar. 9, 2006

(65) Prior Publication Data

US 2007/0120483 A1 May 31, 2007

(30) Foreign Application Priority Data

Nov. 28, 2005 (KR) ..... 10-2005-0114287
Nov. 29, 2005 (KR) ..... 10-2005-0114891

(51) Int. Cl.
*H01J 17/49* (2006.01)

(52) U.S. Cl. ..... 313/582; 313/586

(58) Field of Classification Search ..... 313/582, 313/586, 587

See application file for complete search history.

(56) References Cited

U.S. PATENT DOCUMENTS

| | | | | |
|---|---|---|---|---|
| 6,747,409 | B1 * | 6/2004 | Han et al. | 313/582 |
| 2002/0063523 | A1 * | 5/2002 | Amatsuchi et al. | 313/582 |
| 2002/0084750 | A1 | 7/2002 | Su et al. | |
| 2004/0248048 | A1 | 12/2004 | Lee | |
| 2005/0017652 | A1 | 1/2005 | Kobayashi | |
| 2005/0093776 | A1 | 5/2005 | Furutani | |

FOREIGN PATENT DOCUMENTS

| | | |
|---|---|---|
| EP | 1 017 081 | 7/2000 |
| EP | 1 335 342 | 8/2003 |
| EP | 1 435 639 | 7/2004 |
| EP | 1 381 016 | 1/2005 |
| EP | 1 536 450 | 6/2005 |
| JP | 2003-045344 | 2/2003 |
| JP | 2003-151449 | 5/2003 |
| JP | 2005-66704 | 3/2005 |
| KR | 2001-0003713 | 1/2001 |
| KR | 2003-0072475 | 9/2003 |
| WO | WO 00/05740 | 2/2000 |
| WO | WO 01/88944 | 11/2001 |

OTHER PUBLICATIONS

European Search Report dated Apr. 17, 2007, European Application No. 06001986.6, 7 pages.
European Search Report dated Jul. 11, 2007, European Application No. 06001986.6, 17 pages.

* cited by examiner

*Primary Examiner*—Vip Patel
(74) *Attorney, Agent, or Firm*—Fish & Richardson P.C.

(57) ABSTRACT

The present invention relates to a plasma display apparatus. A bus electrode with high definition is formed and is formed on barrier ribs with a predetermined margin therebetween so that it is not overlapped with a discharge space. Therefore, the bus electrode does not infiltrate into a discharge space due to alignment error on upper/lower substrates. Furthermore, a transparent electrode in which at least one or more projections are formed from the bus electrode to the inside of a discharge space constitutes a scan electrode or a sustain electrode. A width of the transparent electrode is formed to be narrower than that of the bus electrode. Therefore, capacitance by the upper plate electrode can be reduced.

20 Claims, 6 Drawing Sheets

PLASMA DISPLAY APPARATUS

BACKGROUND

1. Field of the Invention

The present invention relates to a plasma display apparatus, and more particularly, to the structure of a bus electrode and a transparent electrode, in which panel capacitance can be reduced.

2. Discussion of Related Art

In general, a plasma display panel is a display apparatus that implements predetermined images using a visible ray of red (R), green (G) and blue (B), which is generated by exciting phosphors with vacuum ultraviolet rays (VUV) radiated from plasma obtained through a gas discharge.

In the plasma display apparatus, a discharge cell is selected by a counter discharge between a scan electrode and an address electrode, and images are implemented by a surface discharge between the scan electrode and a sustain electrode.

More particularly, the construction of the plasma display apparatus will be first described. An upper substrate and a lower substrate opposite to the upper substrate are formed in the panel with them being combined together. A scan electrode, a sustain electrode and a dielectric layer are formed in the upper substrate.

In the lower substrate are formed a plurality of address electrodes, a dielectric layer for protecting the address electrodes and providing insulation, barrier ribs that partition the discharge cells, and a phosphor layer coated on the dielectric layer and the barrier ribs, for radiating a visible ray with a plasma discharge.

Furthermore, in the upper substrate is also formed a dielectric layer for protecting the scan electrode, the sustain electrode and the electrodes, and providing insulation. Each of the scan electrode and the sustain electrode consists of a bus electrode and a transparent electrode.

As a voltage is applied to any one of the address electrode, the scan electrode and the sustain electrode, an address discharge is generated and a discharge cell is selected. Furthermore, a sustain discharge is generated between the scan electrode and the sustain electrode, and images are displayed accordingly.

The structure of the bus electrode of the plasma display apparatus constructed above will be described with reference to FIG. 1 along with problems of the related art.

Referring to FIG. 1, a discharge space is partitioned by a barrier rib 23. Bus electrodes 11*b* are formed on the barrier rib with them being spaced apart by a margin (m1) of less than 20 μm from the discharge space. Furthermore, a width (d1) of the bus electrodes 11*b* in the related art is set to 55 μm to 80 μm.

In a process in which the upper substrate and the lower substrate are combined to form the panel, however, in the case where an alignment value of the upper substrate or the lower substrate exceeds tolerance error, the margin (m1) of the prior art bus electrode 11*b* was not sufficiently secured. Therefore, as shown at the right side of FIG. 1, the bus electrode infiltrates into the discharge space. Therefore, problems arise because a light-emission area from which a visible ray is radiated is decreased and luminance is lowered.

Furthermore, the shape of a transparent electrode 11*a* that is electrically connected to the prior art bus electrode 11*b* will be described below with reference to FIG. 2.

Referring to FIG. 2, the discharge space is partitioned by the barrier rib 23. The bus electrode 11*b* is formed on the barrier rib 23. The transparent electrode 11*a* that projects from the bus electrode 11*b* to the inside of the discharge space is also formed. It is to be understood that the transparent electrode 11*a* and the bus electrode 11*b* are scan electrodes Y connected to a scan driver in FIG. 2.

More particularly, a width (T1) of the transparent electrode 11*a* is set to be wider than a width (T2) of the bus electrode 11*b* so that a cross section of an overlapped area of the transparent electrode 11*a* and the bus electrode 11*b* becomes wide, as shown in FIG. 3. For example, the width (T1) of the transparent electrode 11*a* can be set to about 100 μm and the width (T2) of the bus electrode 11*b* can be set to about 80 μm.

That is, if a cross section where the metal bus electrode 11*b* and the transparent electrode 11*a* to which a driving signal is applied from the scan driver are overlapped with each other becomes wide, a sustain discharge is more smoothly generated. Therefore, in the related art, as shown in FIGS. 2 and 3, the width of the transparent electrode 11*a* projecting into the discharge space is formed to be wide.

As the width of the transparent electrode 11*a* is formed to be wider than that of the bus electrode 11*b*, however, an area where the transparent electrode 11*a* is overlapped with the barrier rib 23, which is indicated by a dotted line of FIG. 2, is also widened. Therefore, a problem arises because panel capacitance rises.

The term "panel capacitance" refers to that capacitance formed in a panel having a characteristic of storing energy by an electric field and inducing a current by voltage shift is equivalently represented.

However, there are problems such as that power consumption is increased and a waveform is distorted, etc. as panel capacitance is higher. For this reason, to reduce panel capacitance, a width of the electrodes formed in the upper substrate or the lower substrate, a gap between the electrode and the like need to be controlled.

SUMMARY OF THE INVENTION

Accordingly, the present invention has been made in view of the above problems, and it is an object of the present invention to provide a plasma display apparatus in which a width of a bus electrode is narrow in order to reduce panel capacitance, margin of the bus electrode is sufficient considering error on an alignment process, and the bus electrode is formed not to infiltrate into a discharge space.

A plasma display apparatus according to an aspect of the present invention includes a first electrode formed in an upper substrate, and barrier ribs that are formed in a lower substrate opposite to the upper substrate and partition a discharge space. The first electrode is not overlapped with the discharge space.

The upper substrate further includes a second electrode parallel to the first electrode. The second electrode is formed on the barrier ribs so that it is not overlapped with the discharge space.

The first electrode or the second electrode is spaced from the outer wall of the discharge space with a predetermined margin there between. The predetermined margin is within a range of 20 to 200 μm.

Furthermore, the first electrode and the second electrode are metal bus electrodes. A width of the bus electrode is set to 50 μm or less. Grooves are formed in the barrier ribs below the first electrode or the second electrode. Therefore, panel capacitance can be reduced.

Furthermore, a transparent electrode that projects from the bus electrode to the inside of the discharge space has a T shape. At least one or more projections extending into the discharge space are formed in the transparent electrode.

The transparent electrode includes a first part overlapped with the bus electrode, a second part in which at least one or more projections projecting from the first part to the inside of the discharge space are formed, and a third part that electrically connects the second part.

More particularly, a width of the first part is formed to be smaller than that of the bus electrode, and a width of the second part is 5% to 30% of a width of a discharge cell.

DETAILED DESCRIPTION OF PREFERRED EMBODIMENTS

The present invention will now be described in connection with preferred embodiments with reference to the accompanying drawings.

A plasma display apparatus according to embodiments of the present invention will be described with reference to FIGS. 4 to 11.

Figure 1:
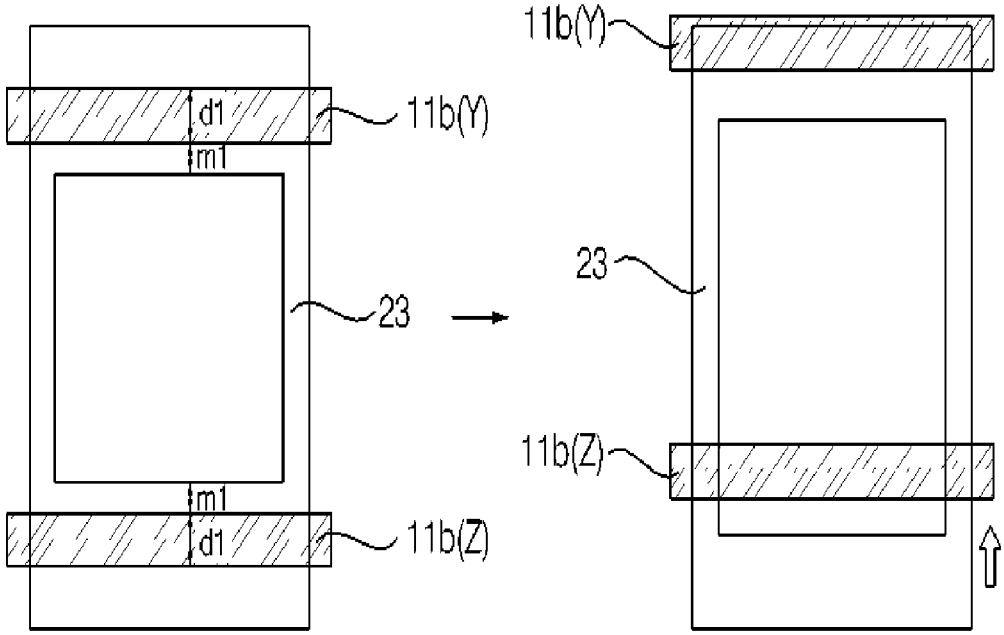
Fig. 1(related art)
FIG. 1 is a plan view illustrating a bus electrode of a plasma display apparatus in the related art.
Figure 2:
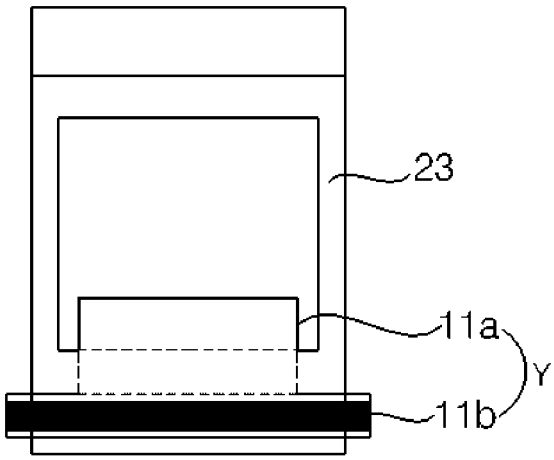
Fig. 2(related art)
FIG. 2 is a plan view illustrating a bus electrode and a transparent electrode of the plasma display apparatus in the related art.
Figure 3:
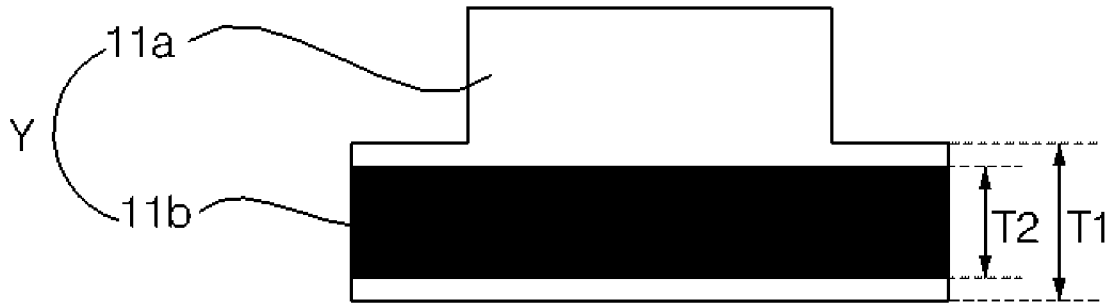
Fig. 3(related art)
FIG. 3 is a plan view illustrating the width of the transparent electrode to the bus electrode in the related art.
Figure 4:
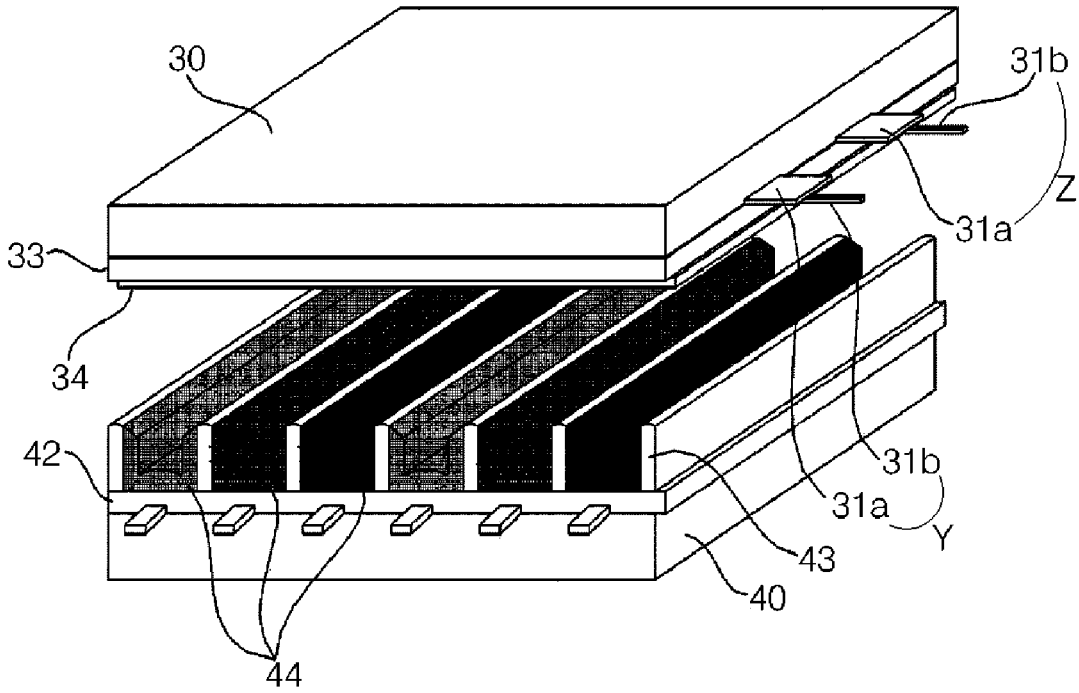
FIG. 4 is a perspective view illustrating the construction of a plasma display panel according to a first embodiment of the present invention.

FIG. 4 is a perspective view illustrating the construction of a plasma display panel according to a first embodiment of the present invention.

It is common that the scan electrodes and the sustain electrodes of the plasma display panel are disposed every discharge cell. It is, however, to be noted that only one scan electrode and one sustain electrode are shown in the drawings for convenience of explanation.

A scan electrode Y and a sustain electrode Z are formed in an upper substrate 30. An upper dielectric layer 33 is laminated adjacent to the scan electrode Y and the sustain electrode Z. Furthermore, a protection layer 34 for protecting the upper dielectric layer 33 is formed on the upper dielectric layer 33.

In a lower substrate 40 are formed address electrodes X crossing the scan electrode Y and the sustain electrode Z formed in the upper substrate 30, and a lower dielectric layer 42 laminated on the address electrodes. A phosphor layer 44 is also coated on the lower dielectric layer 42 and barrier ribs 43 that partition discharge spaces.

In the address period, a counter discharge is generated between the scan electrode Y and the address electrode X and a discharge cell is selected accordingly. In the sustain period, a surface discharge is generated between the scan electrode Y and the sustain electrode Z, and VUV is generated by the discharge. Phosphors 44 coated on the inner surface of the discharge space are excited/emits light to display images.

Figure 5:
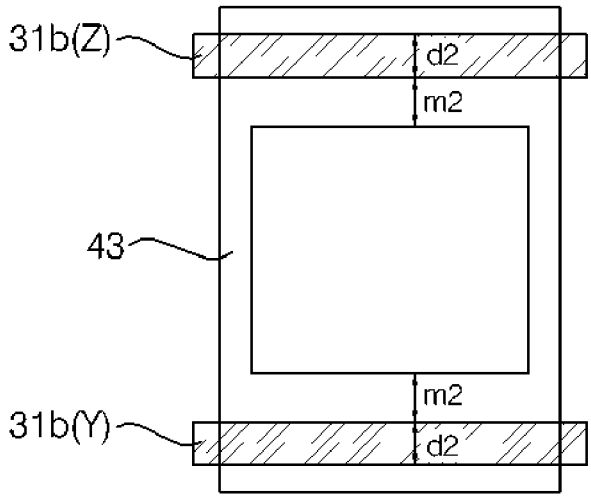
FIG. 5 is a plan view illustrating the structure of a bus electrode of a plasma display apparatus according to a first embodiment.

FIG. 5 is a plan view illustrating the structure of the bus electrode of the plasma display apparatus according to a first embodiment.

Metal bus electrodes 31*b* are opposite to a non-discharge space with a sufficient margin (m2) therebetween in order to prevent the bus electrodes from infiltrating into the discharge space due to error in an alignment process.

One of the bus electrodes shown in FIG. 5 is a scan electrode Y to which a driving signal is applied from a scan driver (not shown), and the other of the bus electrodes is a sustain electrode Z to which the driving signal is applied from the sustain driver (not shown).

The bus electrodes 31*b* are spaced apart from the outer wall of the discharge space with a predetermined margin (m2) therebetween. The predetermined margin (m2) can be preferably in the range of 20 to 200 μm. In view of a current process level, error in the alignment process is within about 20 μm. Therefore, the margin (m2) of the bus electrodes is 20 μm or higher and is 200 μm or less in consideration of the distance of a non-discharge space of neighboring discharge cells.

Furthermore, since the margin (m2) of the bus electrodes 31*b* can be formed long in comparison with the prior art, the distance between the bus electrodes can be increased in comparison with the prior art. Therefore, discharge efficiency can be improved and capacitance between the two electrodes can be reduced.

Furthermore, a width (d2) of the bus electrodes 31*b* can be set to 50 μm or less with high definition. This can lead to reduced capacitance between the two electrodes.

Figure 6:
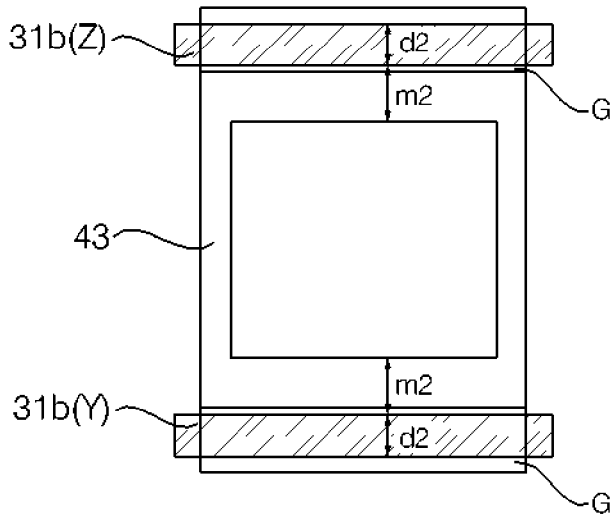
FIG. 6 is a plan view illustrating the structure of a bus electrode of a plasma display apparatus according to a second embodiment.

FIG. 6 is a plan view illustrating the structure of a bus electrode of a plasma display apparatus according to a second embodiment. The structure of the bus electrode shown in FIG. 6 is the same as that shown in FIG. 5 except that grooves G are formed in lower barrier ribs in which metal buses are formed.

Bus electrodes 31*b* according to a second embodiment are formed to be opposite to each other on a non-discharge space so that they are not overlapped with a discharge space, and are spaced apart from the outer wall of the discharge space with a predetermined margin (m2) therebetween. The predetermined margin (m2) can be set to 20 to 200 μm in the same manner as the first embodiment.

Furthermore, a width (d2) of the bus electrodes 31*b* according to a second embodiment can be set to 50 μm or less with high definition. In this case, capacitance between the bus electrodes can be reduced in comparison with the prior art in which the width of the bus electrodes is set to 55 μm or higher.

Furthermore, in the second embodiment, the grooves are formed in the barrier rib 43 in which the bus electrodes 31*b* are formed. Therefore, as shown in FIG. 6, vacant spaces in which air having a low dielectric constant exists are formed below the bus electrodes instead of barrier ribs.

Figure 7:
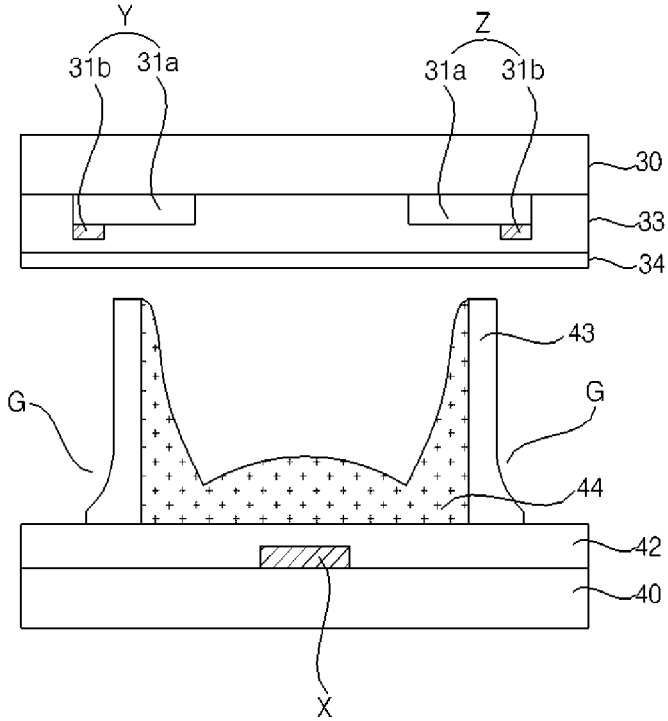
FIG. 7 is a cross-sectional view illustrating the shape of a bus electrode and a barrier rib according to a second embodiment of the present invention.

FIG. 7 is a cross-sectional view of the panel according to a second embodiment. An address electrode X and a dielectric layer 42 are formed on a lower substrate 40. Barrier ribs 43 are formed on the dielectric layer 42 to partition a discharge space. Since grooves (G) are formed in the barrier ribs 43, a dielectric constant of the barrier ribs 43 is lowered by the grooves, and capacitance of the lower substrate 40 is lowered accordingly.

In an upper substrate 30 are formed a scan electrode Y and a sustain electrode Z. A dielectric layer 33 and a protection layer 34 are laminated on the electrodes. However, a bus electrode 31*b* constituting the scan electrode Y and the sustain electrode Z are formed on the grooves (G), and a transparent electrode 31*a* constituting the scan electrode Y and the sustain electrode Z is projected from the bus electrode 31*b* to the inside of the discharge space.

As described above, in the plasma display apparatus according to the first and second embodiments, the width (d2) of the bus electrode 31*b* is set to 50 μm with high definition and the margin (m2) of the bus electrode is sufficiently secured in consideration of error on an alignment process. It is thus possible to prevent the bus electrodes from infiltrating into the discharge space. Furthermore, since the grooves (G) are formed in the barrier ribs 43 of the bus electrodes, there is an advantage in that panel capacitance can be reduced.

FIGS. 8 to 11 are views illustrating the structure of the bus electrode, which projects from the metal bus electrode according to the first embodiment shown in FIG. 5 and the metal bus electrode according to the second embodiment shown in FIG. 6 to the inside of the discharge space. FIGS. 8 to 11 show the shapes of the transparent electrodes according to the first to fourth embodiments, respectively.

Figure 8:
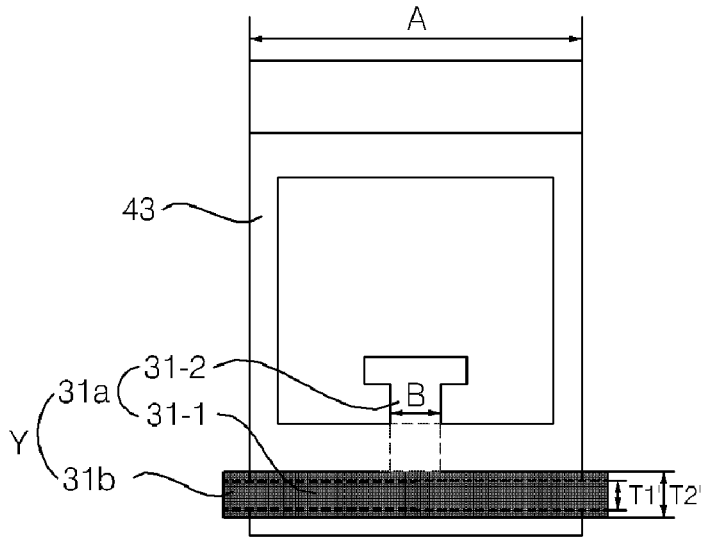
FIG. 8 is a plan view illustrating the structure of a bus electrode and a transparent electrode according to a first embodiment.
Figure 9:
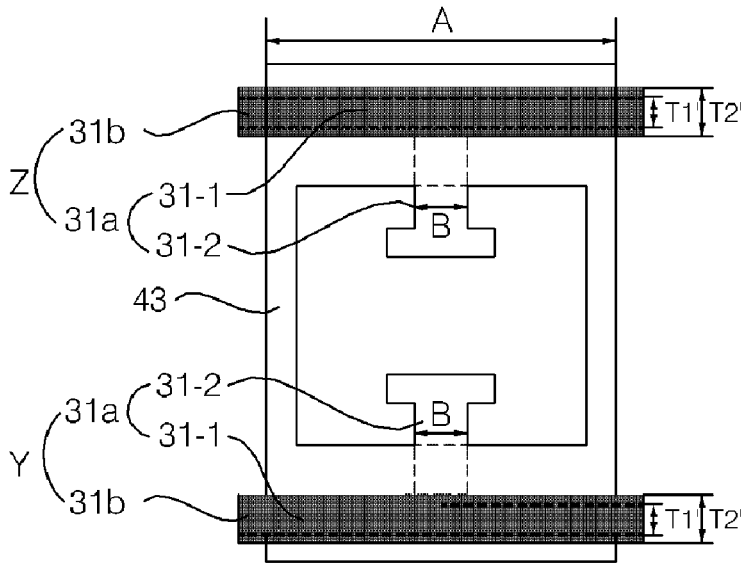
FIG. 9 is a plan view illustrating the structure of a bus electrode and a transparent electrode according to a second embodiment.

In the first embodiment of FIG. 8, only the transparent electrode 31*a* of either the scan electrode Y or the sustain electrode Z is projected in a T form. Referring to FIG. 9, in the second embodiment, the transparent electrodes 31*a* of the scan electrode Y and the sustain electrode Z are projected in a T shape with them being opposite to each other.

The transparent electrode 31*a* electrically connected to the metal bus electrode 31*b* has at least one or more projections of a T shape, which project into the discharge space. The transparent electrode 31*a* includes a first part 31_1 overlapped with the bus electrode 31*b*, and a second part 31_2 in which at least one or more projections are formed from the first part 31_1 to the inside of the discharge space.

The structure of the transparent electrode 31*a* constructed above can be applied to any one of the electrodes provided in the upper substrate in the same manner as the first embodiment of FIG. 8, and the structure of the remaining transparent electrodes is not limited to the present embodiment.

However, the transparent electrodes 31*a* projected into the discharge space are opposite to each other, and a sustain discharge is generated between the transparent electrodes 31*a* by means of a driving signal output from each of the bus electrodes 31*b*.

Furthermore, as in the second embodiment of FIG. 9, in the structure of the transparent electrode, the transparent electrode 31*a* of each of the scan electrode Y and the sustain electrode Z provided in the upper substrate can be projected toward the discharge space in a T shape.

In the transparent electrodes 31*a* according to the first and second embodiments, a width (T1') of the first part 31_1 overlapped with the bus electrode 31*b* is set to be smaller than a width (T2') of the bus electrode. Therefore, the first part 31_1 does not project outside the bus electrode 31*b*.

Furthermore, a width (B) of the second part 31_2 is 5% to 30% of a width (A) of the discharge cell. A cross section of a region overlapped with the barrier ribs 43 indicated by a dotted line is significantly reduced in comparison with the related art. This results in reduced panel capacitance.

Furthermore, since the second part 31_2 of the transparent electrode is formed to have a T shape, a counter area with a counter electrode that generates a sustain discharge is widened and discharge efficiency is enhanced accordingly.

Figure 10:
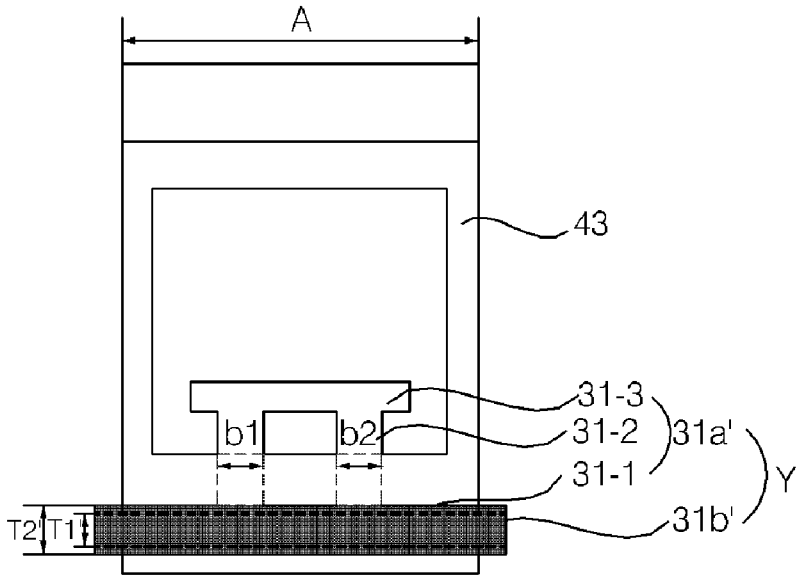
FIG. 10 is a plan view illustrating the structure of a bus electrode and a transparent electrode according to a third embodiment.

In the third embodiment of FIG. 10, at least two or more projections having a T shape are formed in only the transparent electrode 31*a'* of either the scan electrode Y or the sustain electrode Z. In the fourth embodiment of FIG. 11, at least two or more projections having a T shape are formed in the transparent electrode 31*a'* of each of the scan electrode Y and the sustain electrode Z.

Assuming that the electrode shown in FIG. 10 is the scan electrode Y, the metal bus electrode 31*b'* constituting the scan electrode is formed in the non-discharge space so that it is not overlapped with the discharge space. At least two or more projections of a T shape, which are projected into the discharge space, are formed in the transparent electrode 31*a'* electrically connected to the bus electrode 31*b'*.

The transparent electrode 31*a'* includes a first part 31_1 overlapped with the bus electrode 31*b'*, a second part 31_2 in which at least two or more projections are formed from the first part to the inside of the discharge space, and a third part 31_3 that connects the second parts.

The structure of the transparent electrode 31*a'* constructed above can be applied to any one of the electrodes provided in the upper substrate as in the third embodiment of FIG. 10, and the structure of the transparent electrode of the remaining electrodes is not limited to the present embodiment.

However, the transparent electrodes projecting into the discharge space are opposite to each other, and a sustain discharge is generated between the transparent electrodes by means of a driving signal applied from each bus electrode 31*b'*.

Figure 11:
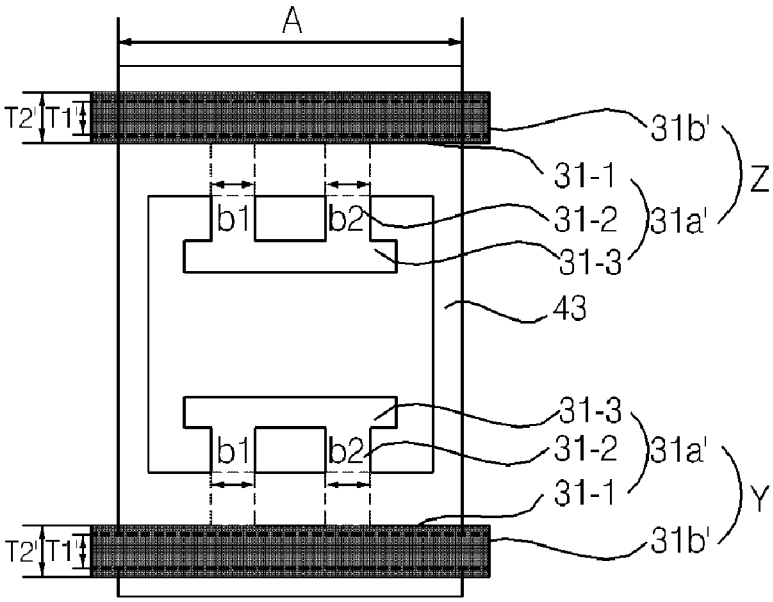
FIG. 11 is a plan view illustrating the structure of a bus electrode and a transparent electrode according to a fourth embodiment.

Furthermore, as in the fourth embodiment of FIG. 11, at least two or more projections having a T shape are formed in the transparent electrode of the scan electrode Y and the sustain electrode Z provided in the upper substrate.

At this time, in the transparent electrode 31*a'* according to the third and fourth embodiments, a width (T1') of the first part 31_1 overlapped with the bus electrode 31*b'* is formed to be smaller than a width (T2') of the bus electrode. Therefore, the first part 31_1 does not project outside the bus electrode 31*b'*.

Furthermore, the sum (b1+b2) of the widths of the second part 31_2 is 5% to 30% of the width (A) of the discharge cell. Therefore, since a cross section of an area where the second part 31_2 is overlapped with the barrier ribs 43 is reduced in comparison with the prior art, panel capacitance can be reduced.

Although the foregoing description has been made with reference to the preferred embodiments, it is to be understood that changes and modifications of the present invention may be made by the ordinary skilled in the art without departing from the spirit and scope of the present invention and appended claims.

What is claimed is:

1. A plasma display apparatus comprising:

a first electrode formed in an upper substrate;

barrier ribs that are formed in a lower substrate opposite to the upper substrate and partition a discharge space; and a transparent electrode projecting from the first electrode to the inside of the discharge space, wherein the transparent electrode includes a first part entirely overlapped by the first electrode, and a second part in which a projection projecting from the first part to the inside of the discharge space is formed.

2. The plasma display apparatus as claimed in claim 1, wherein the upper substrate further comprises a second electrode parallel to the first electrode, and the first electrode and the second electrode are not overlapped with the discharge space.

3. The plasma display apparatus as claimed in claim 1, wherein the first electrode is a metal bus electrode.

4. The plasma display apparatus as claimed in claim 1, wherein the first electrode is spaced apart from the outer wall of the discharge space with a predetermined margin therebetween.

5. The plasma display apparatus as claimed in claim 4, wherein the predetermined margin ranges from 20 to 200 μm.

6. The plasma display apparatus as claimed in claim 1, wherein a width of the first electrode ranges from 20 to 50 μm.

7. The plasma display apparatus as claimed in claim 1, wherein grooves are formed in the barrier fibs.

8. The plasma display apparatus as claimed in claim 1, wherein the transparent electrode is projected in a T shape.

9. The plasma display apparatus as claimed in claim 8, wherein the second part includes at least two or more projections that extend into the discharge space.

10. A plasma display apparatus comprising:

at least one or more barrier ribs that partition a discharge space in a lower substrate;

a first electrode and a second electrode formed in an upper substrate opposite to the lower substrate; and a first transparent electrode and a second transparent electrode corresponding to the first electrode and the second electrode, respectively, the first transparent electrode including a first part overlapped by the first electrode, and a second part including a plurality of projections projecting from the first part to the inside of the discharge space, wherein less than an entire region of the first part is overlapped by the first electrode, and the barrier ribs have formed grooves therein.

11. The plasma display apparatus as claimed in claim 10, wherein the first and second electrodes are spaced apart from the outer wall of the discharge space with a predetermined margin therebetween.

12. The plasma display apparatus as claimed in claim 11, wherein the predetermined margin is from 20 to 200 μm.

13. The plasma display apparatus as claimed in claim 10, wherein a width of each of the first and second electrodes is from 20 to 50 μm.

14. The plasma display apparatus as claimed in claim 10, wherein a width of the second part is 5% to 30% of a width of a discharge cell.

15. A plasma display apparatus comprising:

an upper substrate in which a first electrode is formed; and a lower substrate, which is opposite to the upper substrate and has formed at least one or more barrier ribs, which constitute a discharge space, therein, wherein the first electrode comprises:

a first part that is overlapped by a second electrode, wherein the first part does not extend into the discharge space, and a second part in which a plurality of projections are formed to extend from the first part to the inside of the discharge space, wherein widths of the plurality of projections are different from each other.

16. The plasma display apparatus as claimed in claim 15, wherein the first electrode is a transparent electrode and the second electrode is a bus electrode.

17. The plasma display apparatus as claimed in claim 15, wherein the first electrode further comprises a third part that connects the second part in which at least one or more projections are formed.

18. The plasma display apparatus as claimed in claim 15, wherein a sum of the widths of the plurality of projections is a width of the second part, wherein the width of the second part is 5% to 30% of a width of a discharge cell.

19. The plasma display apparatus of claim 1, wherein the second part further comprises one or more additional projections, the transparent electrode further comprising a third part that connects the projection and the one or more additional projections.

20. The plasma display apparatus of claim 10, wherein the transparent electrode further comprises a third part that connects the plurality of projections.

* * * * *